US011027512B2

(12) United States Patent
Hermann et al.

(10) Patent No.: US 11,027,512 B2
(45) Date of Patent: Jun. 8, 2021

(54) FORMING OF VACUUM BAG PACKAGING

(71) Applicant: CLOVER IMAGING GROUP, LLC, Hoffman Estates, IL (US)

(72) Inventors: Heymo Hermann, Ottawa, IL (US); John Werner, Marseilles, IL (US); Craig Calsyn, Peru, IL (US)

(73) Assignee: CLOVER IMAGING GROUP, LLC, Hoffman Estates, IL (US)

( * ) Notice: Subject to any disclaimer, the term of this patent is extended or adjusted under 35 U.S.C. 154(b) by 126 days.

(21) Appl. No.: 16/382,238

(22) Filed: Apr. 12, 2019

(65) Prior Publication Data

US 2019/0232597 A1 Aug. 1, 2019

Related U.S. Application Data

(62) Division of application No. 14/558,082, filed on Dec. 2, 2014, now Pat. No. 10,293,568.

(60) Provisional application No. 61/911,288, filed on Dec. 3, 2013.

(51) Int. Cl.
*B31D 5/00* (2017.01)

(52) U.S. Cl.
CPC ..... *B31D 5/0069* (2013.01); *B31D 5/0078* (2013.01)

(58) Field of Classification Search
None
See application file for complete search history.

(56) References Cited

U.S. PATENT DOCUMENTS 5,290,490 A 3/1994 Nied et al.
6,085,909 A 7/2000 Lyons
7,114,936 B2 * 10/2006 Oono ..... B29C 45/1418 425/112
8,011,511 B2 9/2011 Oyler et al.

* cited by examiner

*Primary Examiner* — Monica A Huson
(74) *Attorney, Agent, or Firm* — Michael Best & Friedrich LLP

(57) ABSTRACT

A system for forming a vacuum bag packaging material into a desired shape includes subjecting the exterior of the packaging material to a vacuum to expand the packaging material. The expanded packaging material is then pressed into or against a forming device. Expanding the packaging material renders a filler material inside a sealed packaging membrane free flowing, such that the packaging material can assume the shape of the forming device during the pressing operation. When the vacuum is removed, the membrane recompresses upon the filler material and renders it non-free flowing such that the formed packaging material maintains the formed shape during ordinary handling.

9 Claims, 10 Drawing Sheets

FORMING OF VACUUM BAG PACKAGING

CROSS-REFERENCE TO RELATED APPLICATION

This is a divisional of U.S. patent application Ser. No. 14/558,082, titled "Forming of Vacuum Bag Packaging" and filed on Dec. 2, 2014, which claims the benefit of and priority to U.S. Provisional Patent Application No. 61/911,288, filed Dec. 3, 2013, the entire contents of each of the foregoing are hereby incorporated by reference herein.

BACKGROUND

The present disclosure relates to packaging materials and, more particularly, to the forming of certain types of packaging materials to a desired shape. U.S. Pat. No. 6,085,909 ("the '909 patent") and U.S. Pat. No. 8,011,511 ("the '511 patent") disclose reusable flexible packaging pads comprising sealed bags that are filled with foam beads and/or other resilient filler materials. During manufacturing, the bags are filled with beads, compressed, and then sealed such that the pressure on the inside of the sealed bag is less than ambient or atmospheric pressure. The bag is therefore compressed upon the filler materials and renders the filler materials non-free flowing. The resultant vacuum bag packaging has the simultaneous properties of "handling rigidity," whereby the packaging maintains its shape during routine handling, and formability, whereby the packaging can be molded or formed around a part or component during packaging, and will thereafter maintain the molded or formed shape and protect the packaged part or component. The entire contents of both the '909 patent and the '511 patent are hereby incorporated by reference herein.

SUMMARY

In some aspects, a system is provided for forming a packaging material to a desired configuration. The system includes a forming chamber configured to receive the packaging material, a vacuum system fluidly communicating with the forming chamber and operable to establish a vacuum within the forming chamber, and a forming die positioned within the forming chamber. An actuator is operable to urge the packaging material and the forming die into engagement with one another while the vacuum system maintains the vacuum within the forming chamber.

The forming chamber may include a body and a closure sealingly engageable with the body and moveable between an open configuration for placement of the packaging material into the forming chamber and a closed configuration in which the forming chamber is sealed such that the vacuum system is operable to establish the vacuum within the forming chamber. The actuator may include a rod that extends from a location outside the forming chamber to a location inside the forming chamber. The actuator may also include a pressing member located inside the forming chamber for urging the packaging material and the forming die into engagement with one another. The vacuum system may include a first vacuum fitting in a first portion of the forming chamber and a second vacuum fitting in a second portion of the forming chamber. The first vacuum fitting and the second vacuum fitting may be controllable independently from one another. The forming die may include a vent opening providing fluid communication between the vacuum system and the forming chamber.

In other aspects, a method is provided for forming a packaging material to a desired configuration. The method includes placing the packaging material into a forming chamber at ambient pressure, applying a vacuum to the forming chamber, thereby expanding the packaging material, urging the expanded packaging material and a forming die into engagement with one another, thereby forming the expanded packaging material into a shape at least partially corresponding to the forming die, and returning the forming chamber to ambient pressure.

The expanding packaging material and the forming die may be maintained in engagement while the forming chamber is returned to ambient pressure. The expanded packaging material may delimit the forming chamber into a first portion and a second portion. Returning the forming chamber to ambient pressure may include returning the first portion of the forming chamber to ambient pressure before returning the second portion of the forming chamber to ambient pressure. The forming chamber may include a first vacuum fitting and a second vacuum fitting, and returning the forming chamber to ambient pressure may include controlling the first and second vacuum fittings independently from one another. Returning the forming chamber to ambient pressure may compress the packaging material such that the packaging material maintains the shape at least partially corresponding to the forming die. The packaging material may include an unbound filler material surrounded by a sealed membrane having an internal pressure less than ambient pressure such that the membrane compresses the filler material to a non-free flowing state. Applying the vacuum to the forming chamber and expanding the packaging may render the filler material substantially free flowing. Urging the expanded packaging material and the forming die into engagement with one another may cause at least some of the substantially free flowing filler material to flow around and assume the shape at least partially corresponding to the forming die.

In still other aspects a method is provided for forming packaging material to a desired configuration. The packaging material includes an unbound filler material surrounded by a sealed membrane having an internal pressure less than an ambient pressure such that the membrane compresses the filler material into a non-free flowing state. The method includes expanding the membrane by subjecting the packaging material to a vacuum, engaging the packaging material with a forming die while the membrane is expanded, and removing the vacuum.

After engaging the packaging material with the forming die, a first portion of the packaging material may be adjacent the forming die and a second portion of the packaging material may be spaced from the forming die, and removing the vacuum may include removing the vacuum applied to the first portion of the packaging material after removing the vacuum applied to the second portion of the packaging material. Subjecting the packaging material to a vacuum may include placing the packaging material into a forming chamber. Engaging the packaging material with a forming die may include operating an actuator to urge the packaging material into engagement with the forming die. The membrane may remain sealed throughout the steps of expanding, engaging, and removing.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Also, it is to be understood that the phraseology and terminology used herein is for the purpose of description and should not be regarded as limiting.

DETAILED DESCRIPTION

Figures 1, 2:
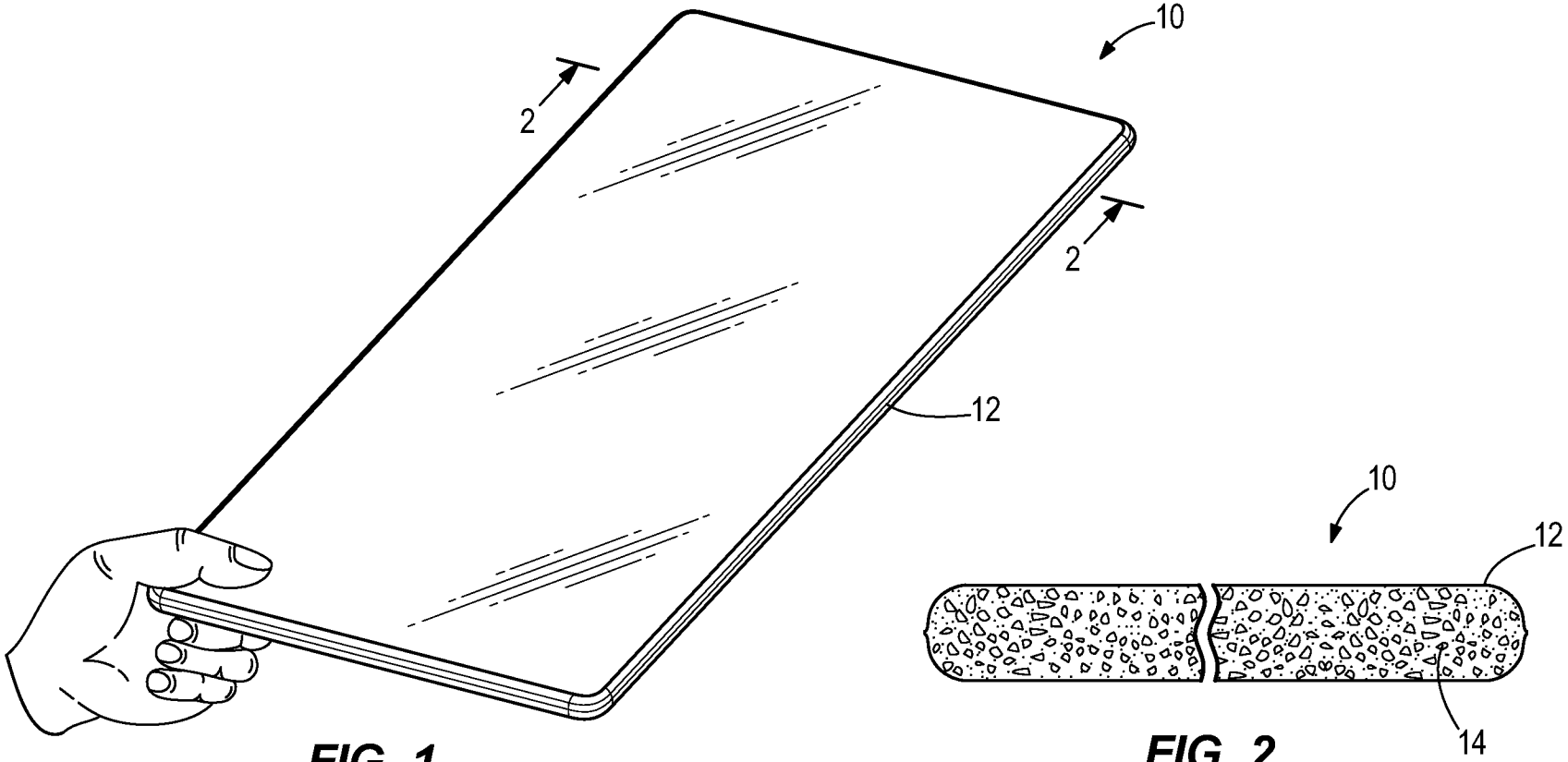
FIG. 1 is a perspective view of a vacuum bag packaging material that may be formed into various shapes in accordance with the present teachings.
FIG. 2 is a section view of the vacuum bag packaging material taken along line 2-2 of FIG. 1.
Figure 3:
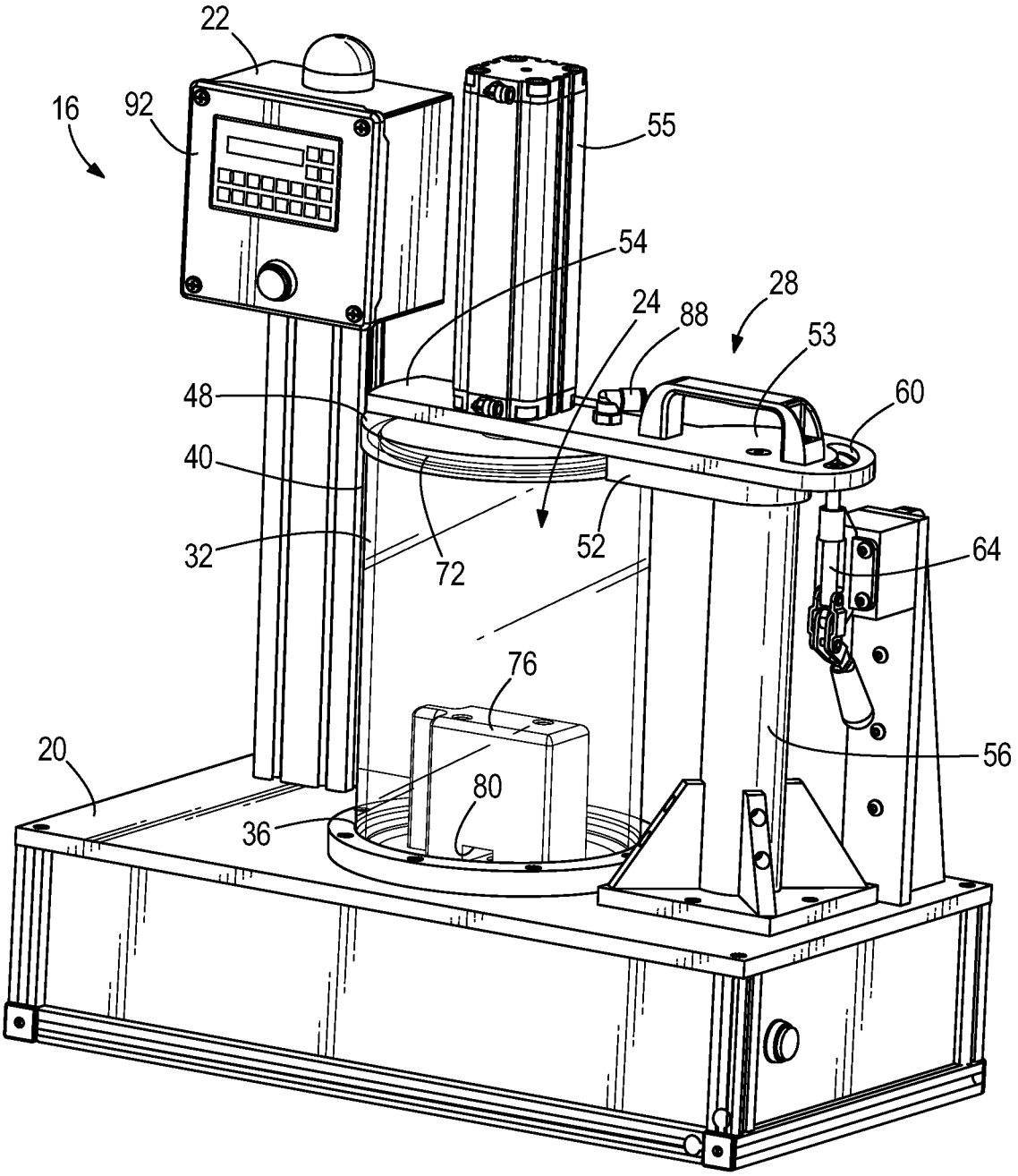
FIG. 3 is a perspective view of a forming machine for the vacuum bag packaging material of FIG. 1.
Figure 4:
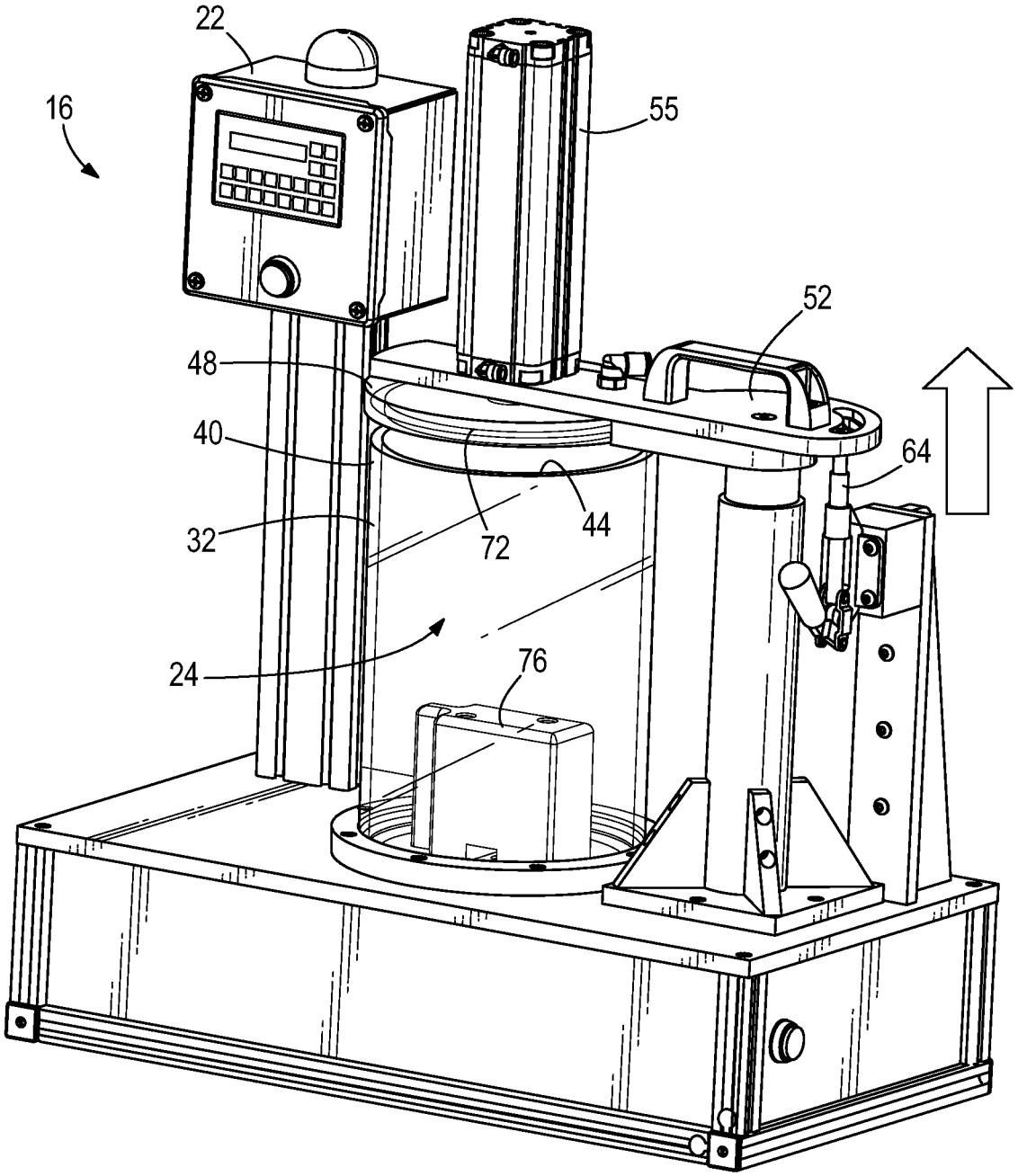
FIG. 4 is a perspective view of the forming machine of FIG. 3 with a clamping arm in a raised position.

FIGS. 1 and 2 illustrate a packaging material 10 formed in accordance with the teachings of the '909 and '511 patents identified in the Background. In the illustrated configuration the packaging material is in the form of a flat board or sheet, which renders the packaging material relatively easy to store and transport. As shown in FIG. 2, an outer membrane 12 surrounds a filler material 14. As discussed above, because the pressure inside the membrane 12 is less than the ambient pressure, the membrane 12 compresses the filler material 14 and renders the filler material "non-free flowing," which is to say the packaging material 10 maintains its shape (e.g., generally flat) during normal handling. The packaging material 10 may, however, be formed into various shapes and configurations, for example, by manually folding and pressing the packaging material into a container, and then pressing or folding a product to be packaged into the material. In so doing, the pressure applied during insertion of the packaging material 10 into the container and during the pressing of the product into the material 10 can cause the filler material 14, to a limited extent, to conform around the product or to the container. This process can be somewhat inefficient and of limited effectiveness due to the substantial friction between the individual particles of filler material 14, and because the outer membrane 12 maintains a constant compressive force against the filler material. As a result, such forming may be limited to those circumstances where the product being packaged is relatively rigid and durable. Furthermore, the degree to which the packaging material 10 conforms to the specific shape and contour of the container and the product being packaged can be fairly limited.

Referring now to FIGS. 3-10, an exemplary forming system 16 is provided that is operable to form the packaging material 10 into desired shapes and contours by subjecting the exterior of the packaging material 10 to vacuum and pressing the packaging material 10 into or against a forming device, such as a forming die and/or a forming chamber. By subjecting the packaging material 10 to a vacuum, the membrane 12 expands such that the filler material 14 is able to move more freely within the membrane 12. When the expanded packaging material 10 is pressed into or against a forming device, the filler material 14 may flow into or around the forming device and may assume a shape that closely matches the shape of the forming device. The vacuum may be removed while the packaging material 10 is engaged with the forming device. As the packaging material 10 is subjected to ambient pressure, the membrane 12 once again compresses the filler material 14 and the filler material 14, having assumed a shape corresponding to the shape of the forming device, reassumes a non-free flowing state. The formed packaging material 10 may then be removed from the forming device and thereafter holds the shape imparted by the forming device during normal handling and use. The packaging material may then be used to package and protect the product for which it was formed.

Although a wide variety of uses are possible, the processes discussed herein are particularly well suited for the formation of end caps and similar packaging materials where the packaging material does not necessarily surround the entire product. Regardless of the particular use, after the packaging material 10 has been formed and used to pack and/or ship a particular product, the previously-formed packaging material 10 may be reformed into a different shape and reused to package a different product. For example, after the packaging material 10 has been formed and used a first time, the forming process discussed herein may be performed a second time and the packaging material 10 may be formed into a different shape for packaging a different product. This process may be repeated over and over, generally so long as the membrane 12 remains intact and is able to maintain the lower-than-ambient pressure on the interior of the packaging material 10.

The illustrated forming system 16 includes a base 20, a control system 22 mounted to one side of the base 20, a forming chamber 24 mounted generally in the center of the base 20, and a pivot arm assembly 28 mounted to another side of the base 20 and operable to open and close the forming chamber 24. The illustrated forming chamber 24 includes a cylindrical body 32 with a lower end 36 sealingly coupled to the base 20 and an upper end 40 that defines an upper opening 44. The forming chamber 24 also includes a closure or lid 48 that is coupled to the pivot arm assembly 28 and is sealingly engageable with the upper opening 44 to seal the forming chamber 24.

Figure 8:
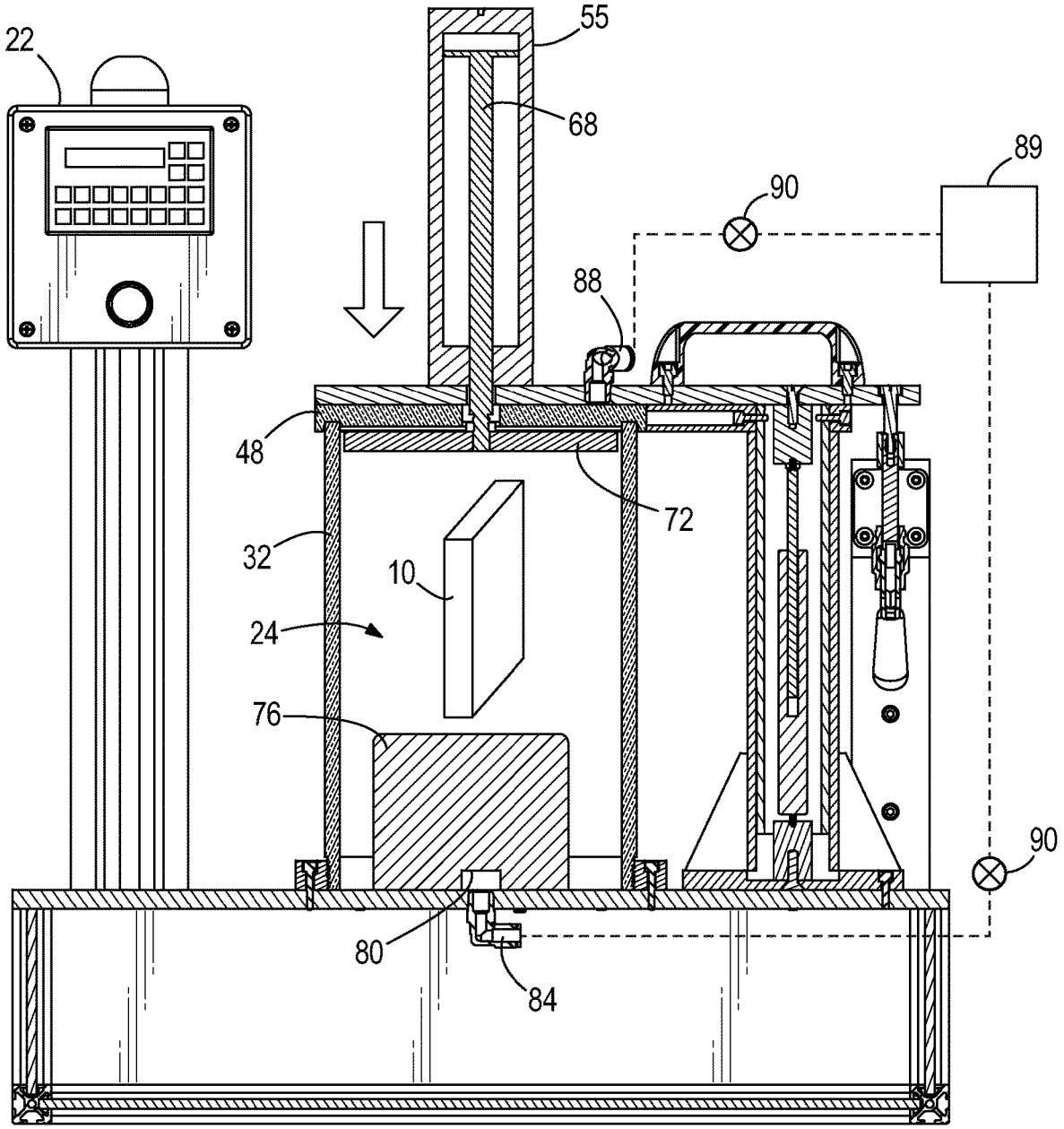
FIG. 8 is a section view taken along line 8-8 of FIG. 7 and showing the forming machine with the clamping arm in the closed and lowered position with a vacuum bag packaging material inserted into the sealed forming chamber.
Figure 9:
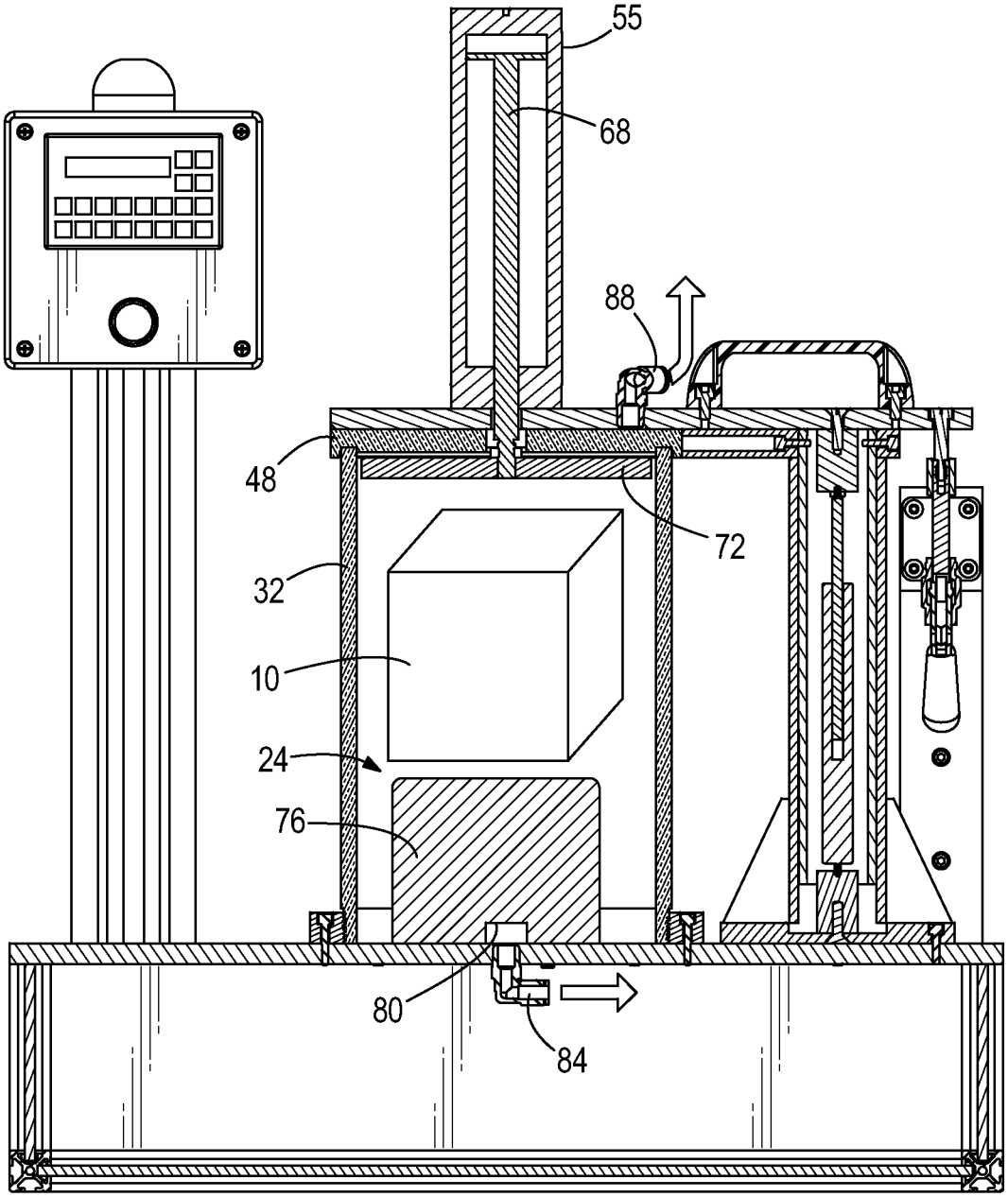
FIG. 9 is a section view similar to FIG. 8 and showing the vacuum bag packaging material in an expanded configuration due to establishing a vacuum within the forming chamber.
Figure 10:
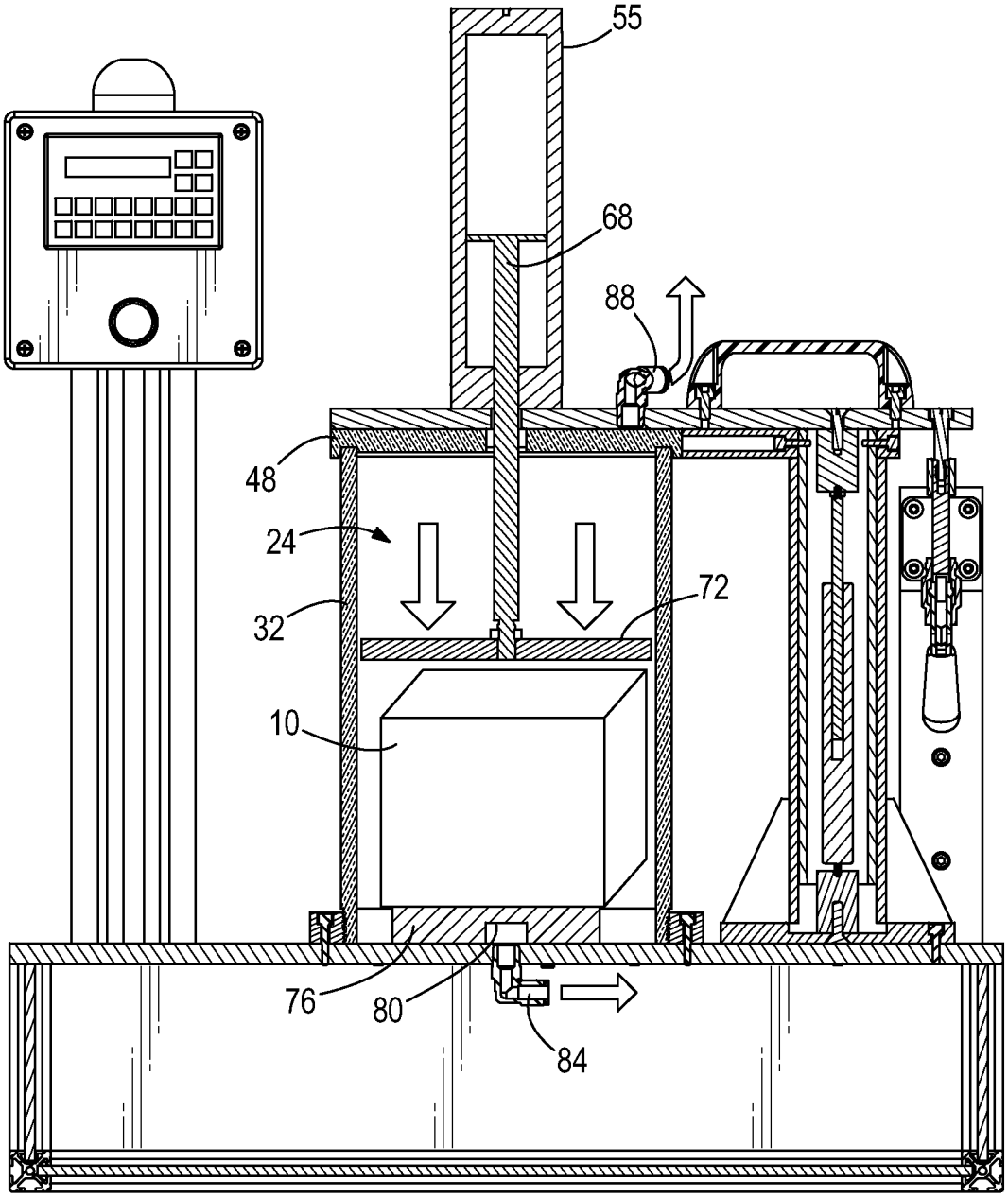
FIG. 10 is a section view similar to FIG. 8 and showing an actuator in a lowered position that presses the vacuum bag packaging material against a forming die.

The pivot arm assembly 28 includes a pivot arm 52 having a first end 53 moveably coupled to the base 20 by way of a telescoping support post 56, and a second end 54 supporting an actuator 55 on one side of the pivot arm and the lid 48 on the other. The support post 56 is configured to allow both pivotal and translational (e.g., up and down) movement of the pivot arm 52 during operation, for reasons discussed further below. The first end 53 of the pivot arm 52 is provided with a curved slot 60 that receives a portion of a detent latch assembly 64. The latch assembly 64 is operable to raise and lower the pivot arm 52 with respect to the base 20, while the curved slot 60 allows the pivot arm 52 to pivot relative to the latch assembly 64. As best seen in FIGS. 8-10, the actuator 55 includes a rod 68 that extends through the pivot arm 52 and through the lid 48. A pressing member or ram in the form of a generally circular plate 72 is coupled to the end of the rod 68 and is moveable therewith during operation of the actuator 55. In the illustrated configurations, clearance is provided between the outer edges of the plate 72 and the inner walls of the forming chamber 24 such that the plate 72 does not delimit or pneumatically divide the chamber 24.

The forming system 16 also includes a forming die 76 that, in the illustrated configuration, is fixed to the base and positioned at the lower end 36 of the forming chamber 24. The illustrated forming die 76 is a generally rectangular prism with rectangular projection along one end, and is selected to approximate the shape of one end of a printer toner cartridge. It should be appreciated, however, that the forming die 76 can be made in substantially any shape to correspond to substantially any product that is desired to be packaged within the formed packaging material 10.

A lower portion of the illustrated forming die 76 is provided with a vent opening 80 that provides fluid communication between the forming chamber 24 and a lower or first vacuum fitting 84 (FIGS. 8-10) associated with a lower portion of the forming chamber 24. An upper or second vacuum fitting 88 is mounted on the pivot arm 52 and communicates and is associated with an upper portion of the forming chamber 24 by way of openings provided in the pivot arm 52 and the lid 48. Each vacuum fitting 84, 88 fluidly communicates with a vacuum system including a vacuum source 89 (FIG. 8) and suitable fluid control devices 90 (e.g., pressure regulators, control valves, and the like) capable of independently controlling the amount of vacuum applied to each fitting 84, 88. In some configurations, each fitting 84, 88 may be provided with its own vacuum source 89. In some methods of operation, the ability to maintain a vacuum in the vicinity of the forming die 76 while eliminating the vacuum in the upper portion of the forming chamber 24 may improve the degree to which the packaging material 10 conforms to the forming die 76 during a forming operation, which may result in improved packaging characteristics for the finished product. Although the illustrated configuration includes a single vent opening 80 in the form of a slot at the bottom of the forming die 76, a plurality of vent openings may also be provided by forming holes or other passageways throughout the forming die 76 to achieve a desired vacuum profile.

The control system 22 electrically communicates with system components such as the actuator 55, the vacuum source 89, the fluid control devices 90, and any other actuators or electrically operated or controlled devices that might be incorporated into the system 16. The control system 22 may include a user interface 92 (FIG. 3), one or more processors, memory, switches, relays, and other hardware, and may be operable to define and execute software programs for operating the system 16. The control system 22 may send commands and receive inputs used to control the system 16. For example, the system 16 may include sensors, such as micro switches and vacuum sensors, that inform the control system 22 of the status of the system components and of the vacuum level or levels within the forming chamber 24.

Figure 5:
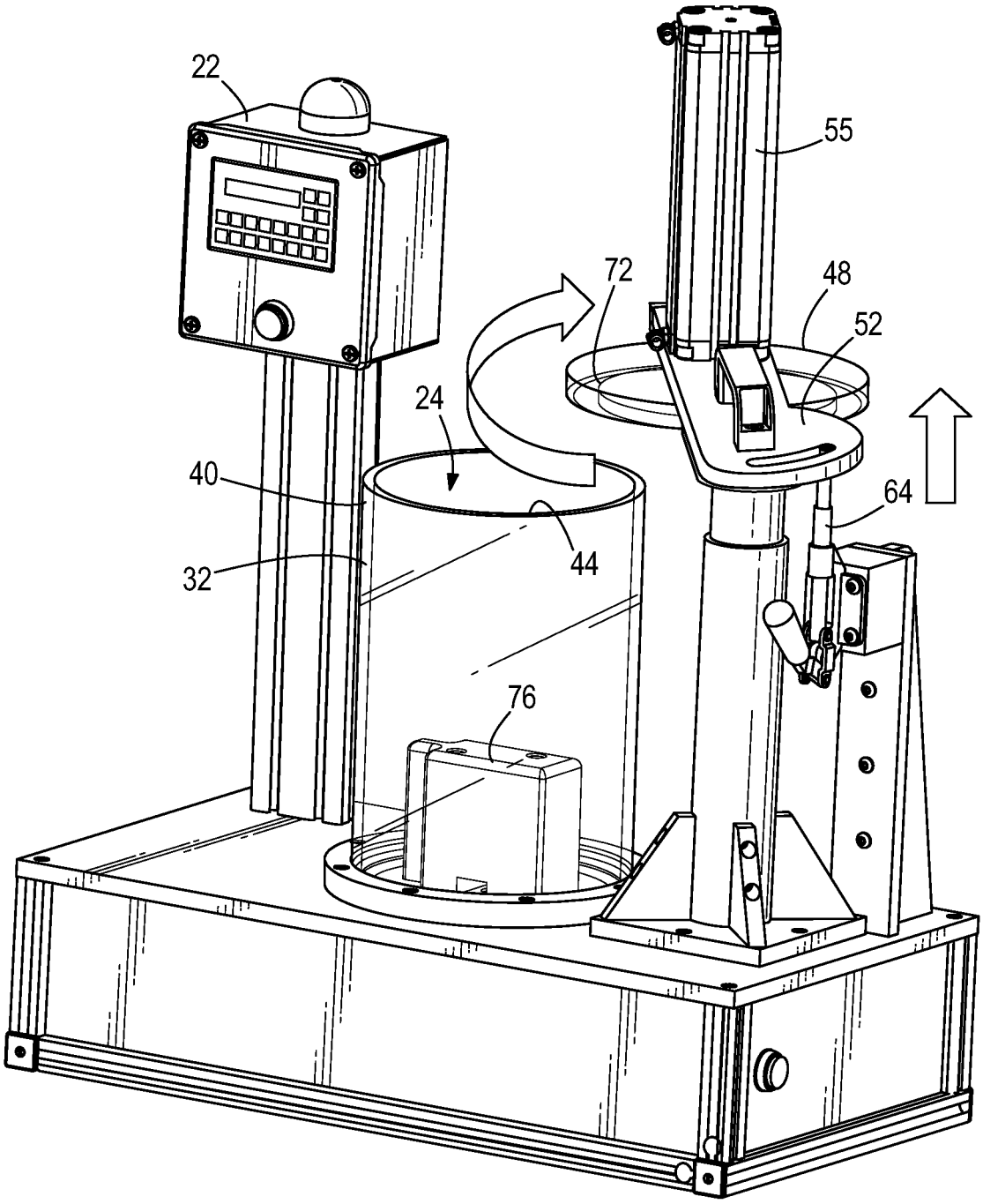
FIG. 5 is a perspective view of the forming machine of FIG. 3 with the clamping arm in a raised and open position that affords access to a forming chamber.
Figure 6:
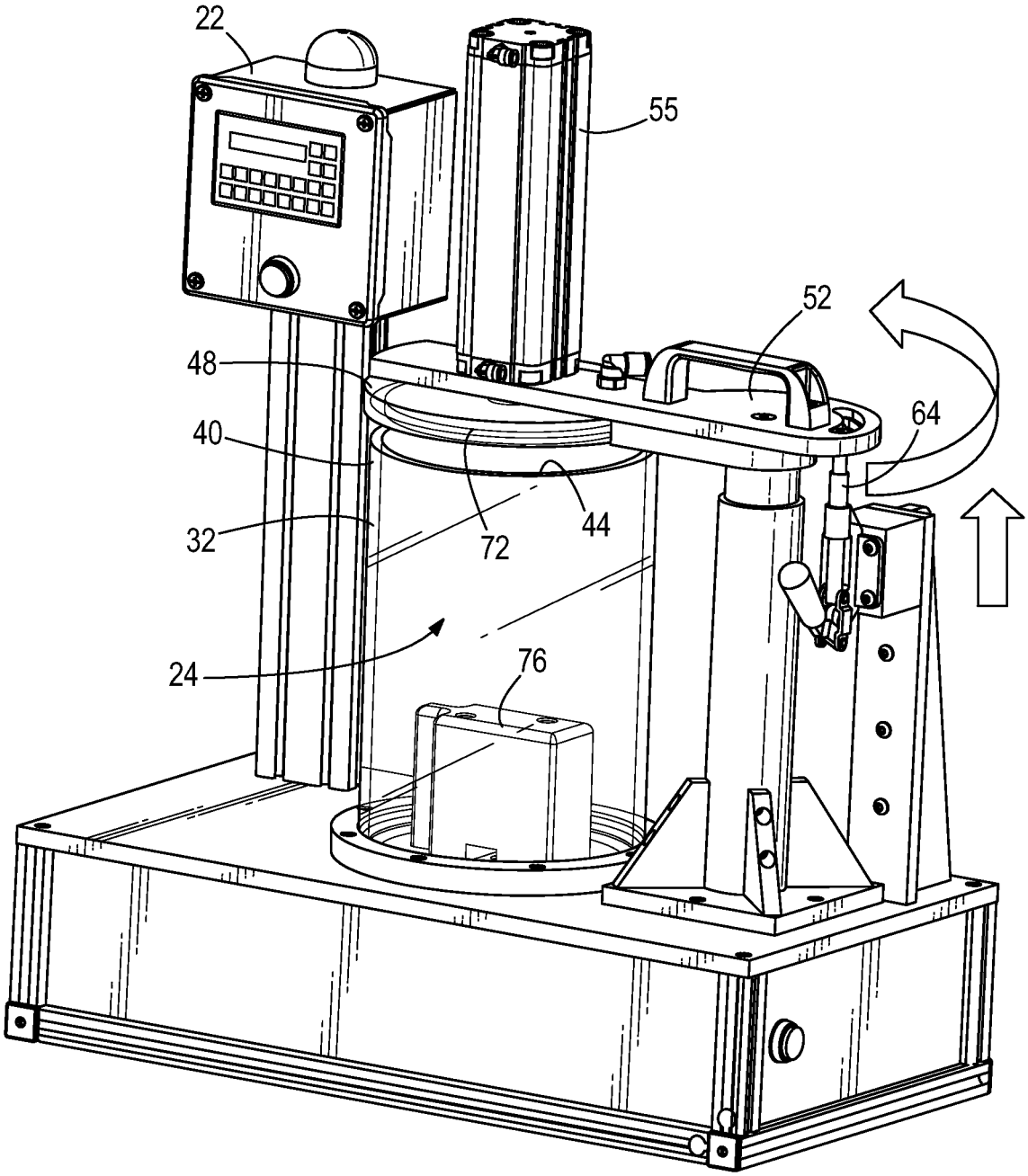
FIG. 6 is a perspective view of the forming machine of FIG. 3 with the clamping arm in a closed and raised position.
Figure 7:
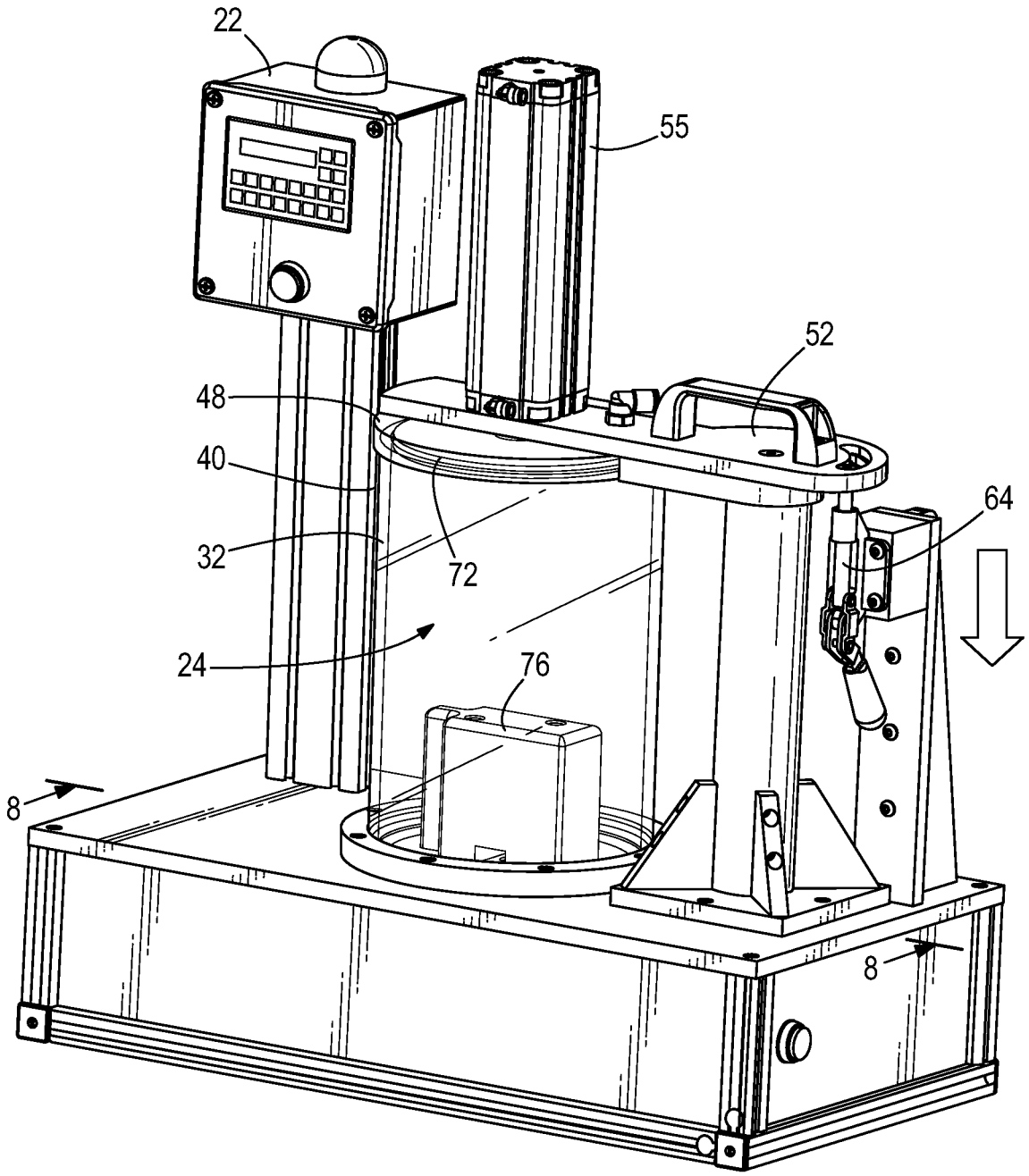
FIG. 7 is a perspective view of the forming machine of FIG. 3 with the clamping arm in a closed and lowered position.

To operate the illustrated system 16, a user manipulates the latch assembly 64 to raise the pivot arm 52 (FIG. 4) such that the lid 48 and the plate 72 are raised above the upper opening 44 of the forming chamber 24. The latch assembly 64 includes a first detent mechanism that holds the pivot arm 52 in the raised position until the latch assembly 64 is once again manipulated by a user. With the pivot arm 52 raised, the pivot arm 52 is pivoted about the support post 56 to expose the upper opening 44 of the forming chamber 24 (FIG. 5). A packaging material 10 to be formed may then be inserted into the forming chamber 24 through the upper opening 44 and the pivot arm 52 may be pivoted such that the lid 48 is again positioned over the upper opening 44 (FIG. 6). The latch assembly 64 may then be operated to lower the lid 48 and to move the lid 48 into sealing engagement with the upper end 40 of the body 32 of the forming chamber 24 (FIG. 7). The latch assembly 64 includes a second detent mechanism that holds the lid 48 in secure, sealed engagement with the body 32 of the forming chamber 24. In other embodiments, movement and operation of the pivot arm 52 may be automated using suitable actuators, and may be controlled by the control system 22.

With the packaging material 10 positioned in the sealed forming chamber 24 (FIG. 8), formation of the packaging material 10 may commence. The control system 22 operates the vacuum system to establish a reduced pressure or vacuum at the lower and upper vacuum fittings 84, 88. The vacuum may be established substantially simultaneously, or one of the fittings 84, 88 may be subjected to the vacuum before the other fitting, depending on the specifics of a particular operation. As a vacuum is formed in the forming chamber 24, the pressure on the outside of the packaging material 10 becomes equal to, and eventually becomes less than, the internal pressure of the packaging material 10 as determined during the original manufacturing of the packaging material 10. As the pressure in the forming chamber 24 becomes less than the internal pressure of the packaging material 10, the membrane 12 begins to expand and the filler material 14 is able to more readily flow within the expanded membrane (FIG. 9).

In some configurations, the pressure in the forming chamber 24 is reduced to a value that is at least about 4 psi less than ambient pressure. In other configurations, the pressure in the forming chamber 24 is reduced to a value that is at least about 6 psi less than ambient pressure. In still other configurations, the pressure in the forming chamber 24 is reduced to a value that is at least about 8 psi less than ambient pressure. In some configurations, the pressure in the forming chamber is reduced to a value that is about 8.8 psi less than ambient pressure.

Figure 11:
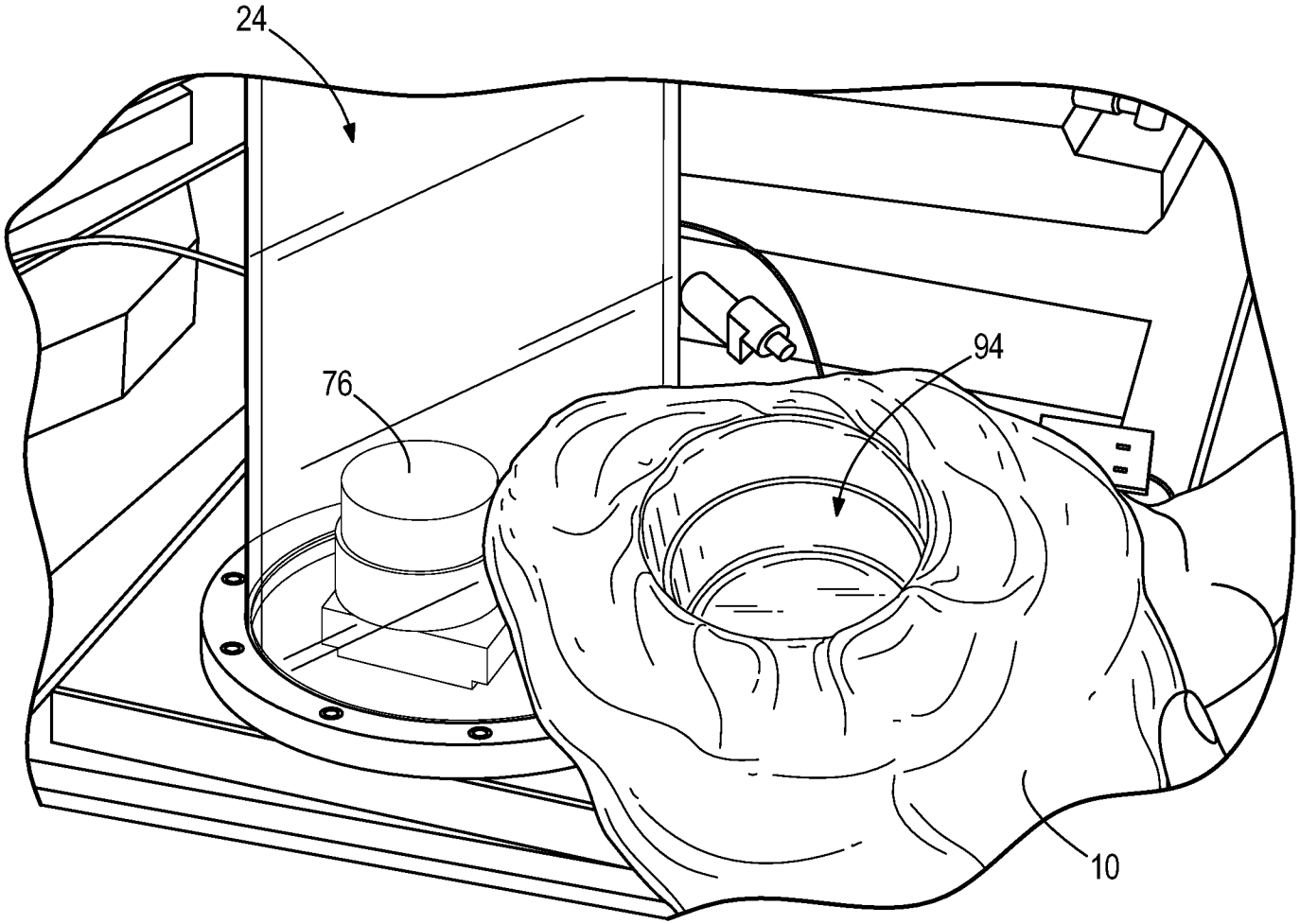
FIG. 11 is a perspective view of the vacuum bag packaging material after being formed in accordance with the present teachings.

While maintaining the desired level of vacuum in the forming chamber 24, the actuator 55 is activated to lower the circular plate 72 and press the expanded packaging material 10 against the forming die 76 (FIG. 10). In one method of operation, as the actuator 55 presses the packaging material 10 against the forming die 76, the vacuum fittings 84, 88 are returned to a non-reduced pressure, such as ambient pressure, for example by venting the fittings 84, 88 to the atmosphere. As a result, the pressure on the outside of the membrane 12 is raised to a level above the pressure on the inside of the membrane 12, and the membrane 12 once again compresses down upon the filler material 14 to rigidify the packaging material 10 by rendering the filler material non-free flowing. The combination of forces applied by the actuator 55 and by the change in pressure in the forming chamber 24 causes the packaging material 10 to compress upon and closely form around the forming die 76. After the forming chamber 24 is returned to atmospheric pressure, the actuator 55 can be operated to lift the plate 72 away from the formed packaging material and the pivot arm 52 can be operated to expose the upper opening 44. The formed packaging material 10 can then be removed from the forming chamber. When the formed packaging material 10 is removed, it is once again in a non-free flowing state and, in the illustrated configuration, defines a cavity 94 having a shape corresponding to the shape of the forming die 76 (FIG. 11).

In some configurations, the packaging material 10 may expand to such an extent that, when the forming chamber 24 attains a sufficient vacuum, the membrane 12 engages the inner wall of the forming chamber 24 around the entire circumference of the forming chamber 24. As a result, the expanded packaging material 10 may at least partially seal or otherwise delimit the upper portion of the forming chamber 24 from the lower portion of the forming chamber 24. In such instances, another method of operation may be utilized to manage independently the upper and lower pressure zones that may be created within the forming chamber 24 by the expanded packaging material. For example, with the vacuum established in the forming chamber 24 and packaging material 10 expanded, the actuator 55 is activated to lower the circular plate 72 and press the expanded packaging material 10 against the forming die 76. Substantially simultaneously with or shortly after actuation of the actuator 55, the upper vacuum fitting 88 is returned to a non-reduced pressure (e.g., ambient), while the lower vacuum fitting 84 is maintained at the reduced pressure. With ambient pressure on the upper portion of the packaging material 10 and reduced pressure on the lower portion of the packaging material 10, the lower or inner portion of the packaging material is firmly urged into engagement with the forming die 76. Once the actuator 55 has completed its stroke and pressed the packaging material 10 fully against the forming die 76, the lower vacuum fitting 84 is returned to a non-reduced pressure (e.g., ambient), which allows the formed packaging material 10 to be removed from the forming die 76.

Although not illustrated in the exemplary embodiment, movement and operation of the pivot arm 52 or another opening and sealing mechanism for the forming chamber 24 may be automated by way of one or more additional actuators. Such additional actuators may be controlled by the control system 22 in sequence with operation of the actuator 55 and operation of the vacuum system to increase or decrease the vacuum level to the lower and upper vacuum fittings 84, 88. In addition, a pick and place robot or other automated manipulator, which may also be controlled by the control system 22, may be used to position the pre-formed packaging material 10 in the forming chamber 24 and to remove the formed packaging material 10 from the forming chamber 24.

In other alternative embodiments, the forming die 76 may be moveable within the forming chamber 24, and/or the forming chamber 24 may be provided with multiple fixed and/or moveable forming dies 76 to attain a desired configuration of finished product. For example, a fixed forming die may be provided in the bottom of the forming chamber 24 and moveable dies may be provided in the sides of the chamber and may move inwardly as the packaging material 10 is pressed onto the fixed forming die, resulting in a formed packaging material 10 having three distinct cavities. It should also be appreciated that the shape and configuration of the forming chamber 24 may be selected to produce a desired finished geometry of the formed packaging material 10. For example, while the illustrated embodiment shows a generally cylindrical forming chamber 24, an alternative forming chamber 24 may have a generally rectangular cross section. The cross section of the forming chamber 24 may be selected to substantially correspond to the dimensions of a box into which the finished packaging material 10 is intended to fit. In addition, the forming system 16 may include a plurality of forming chambers 24 each having its own forming die or dies 76 and connected to a common vacuum control system for the simultaneous formation of multiple packaging materials 10.

Although the present teachings have specifically referenced packaging materials of the type identified in the '511 and '909 patents, the present teachings may be applied to substantially any type of packaging where a loose, unbound filler material is surrounded by a sealed membrane having an internal pressure that is lower than ambient pressure such that the filler material is compressed by the membrane to produce a material having handling rigidity. In addition to expanded polystyrene and other expanded foam materials, the filler material may also or alternatively include a variety of reused or recycled materials such as ground rubber, shredded paper or cardboard, shredded or ground plastic materials, textiles, and the like.

While specific embodiments have been illustrated and described, numerous modifications come to mind without significantly departing from the spirit of the disclosure, and the scope of protection is to be commensurate with the scope of the accompanying claims.

What is claimed is:

1. A system for forming a packaging material to a desired configuration, the system comprising:

a forming chamber configured to receive the packaging material, the forming chamber including a body and a closure sealingly engageable with the body and moveable between an open configuration for placement of the packaging material into the forming chamber and a closed configuration in which the forming chamber is sealed with the packing material wholly within the sealed forming chamber;

a vacuum system fluidly communicating with the forming chamber and operable to establish a vacuum within the sealed forming chamber around the entire packaging material;

a forming die positioned within the forming chamber; and an actuator operable to urge the packaging material and the forming die into engagement with one another while the vacuum system maintains the vacuum within the forming chamber.

2. The system of claim 1, wherein the actuator includes a rod that extends from a location outside the sealed forming chamber to a location inside the sealed forming chamber and a pressing member located inside the sealed forming chamber, the pressing member being movable inside the sealed forming chamber under the influence of the actuator to urge the packaging material and the forming die into engagement with one another.

3. The system of claim 1, wherein the vacuum system includes a first vacuum fitting in communication with a first portion of the sealed forming chamber and a second vacuum fitting in communication with a second portion of the sealed forming chamber.

4. The system of claim 3, further comprising a control system that independently controls vacuum applied to the sealed forming chamber through each of the first vacuum fitting and the second vacuum fitting.

5. The system of claim 1, wherein the forming die includes a vent opening providing fluid communication between the vacuum system and the sealed forming chamber.

6. The system of claim 2, wherein the rod extends through the closure.

7. The system of claim 3, wherein at least one of the first and second vacuum fittings communicates with the sealed forming chamber through the closure.

8. The system of claim 3 wherein the first portion of the sealed forming chamber is delimited from the second portion by the packaging material as a consequence of the packaging material expanding in response to the vacuum within the sealed forming chamber.

9. The system of claim 8, wherein the vacuum within the sealed forming chamber includes a first vacuum formed in the first portion of the sealed forming chamber and a second vacuum, separate from the first vacuum, formed in the second portion of the sealed forming chamber when the packaging material delimits the first portion from the second portion.

* * * * *